United States Patent [19]

Nagase et al.

[11] Patent Number: 4,597,915

[45] Date of Patent: Jul. 1, 1986

[54] CARBURETOR PERCOLATION PREVENTION SYSTEM

[75] Inventors: Hidenobu Nagase, Saitama; Yuji Makino, Tokyo, both of Japan

[73] Assignee: Honda Giken Kogyo Kabushiki Kaisha, Tokyo, Japan

[21] Appl. No.: 573,488

[22] Filed: Jan. 24, 1984

[30] Foreign Application Priority Data

Jan. 27, 1983 [JP] Japan ..... 58-11961

[51] Int. Cl.[4] ..... F02M 5/10

[52] U.S. Cl. ..... 261/29; 261/72 R; 261/DIG. 51; 261/DIG. 81

[58] Field of Search ..... 261/DIG. 81, DIG. 51, 261/72 R, 29

[56] References Cited

U.S. PATENT DOCUMENTS 2,986,133 5/1961 Mattson ..... 261/72 R
3,486,524 12/1969 Brooks ..... 261/72 R
4,448,734 5/1984 Shibano ..... 261/72 R

FOREIGN PATENT DOCUMENTS 45-30364 9/1966 Japan ..... 261/72 R
54-5136 1/1979 Japan ..... 261/DIG. 81
55-112844 1/1980 Japan ..... 261/DIG. 81
58-85356 5/1983 Japan ..... 261/DIG. 81

*Primary Examiner*—Tim Miles
*Attorney, Agent, or Firm*—Lyon & Lyon

[57] ABSTRACT

The invention discloses a carburetor percolation prevention system which utilizes an electrically controlled fuel drain valve disposed in a fuel drain passage between the carburetor float chamber and the fuel tank. The electrical fuel drain valve is opened only when the engine condition sensor and the temperature sensor indicate that both the ignition switch is de-energized and the temperature near the float chamber exceeds a predetermined level.

1 Claim, 1 Drawing Figure

CARBURETOR PERCOLATION PREVENTION SYSTEM

Figure 1:
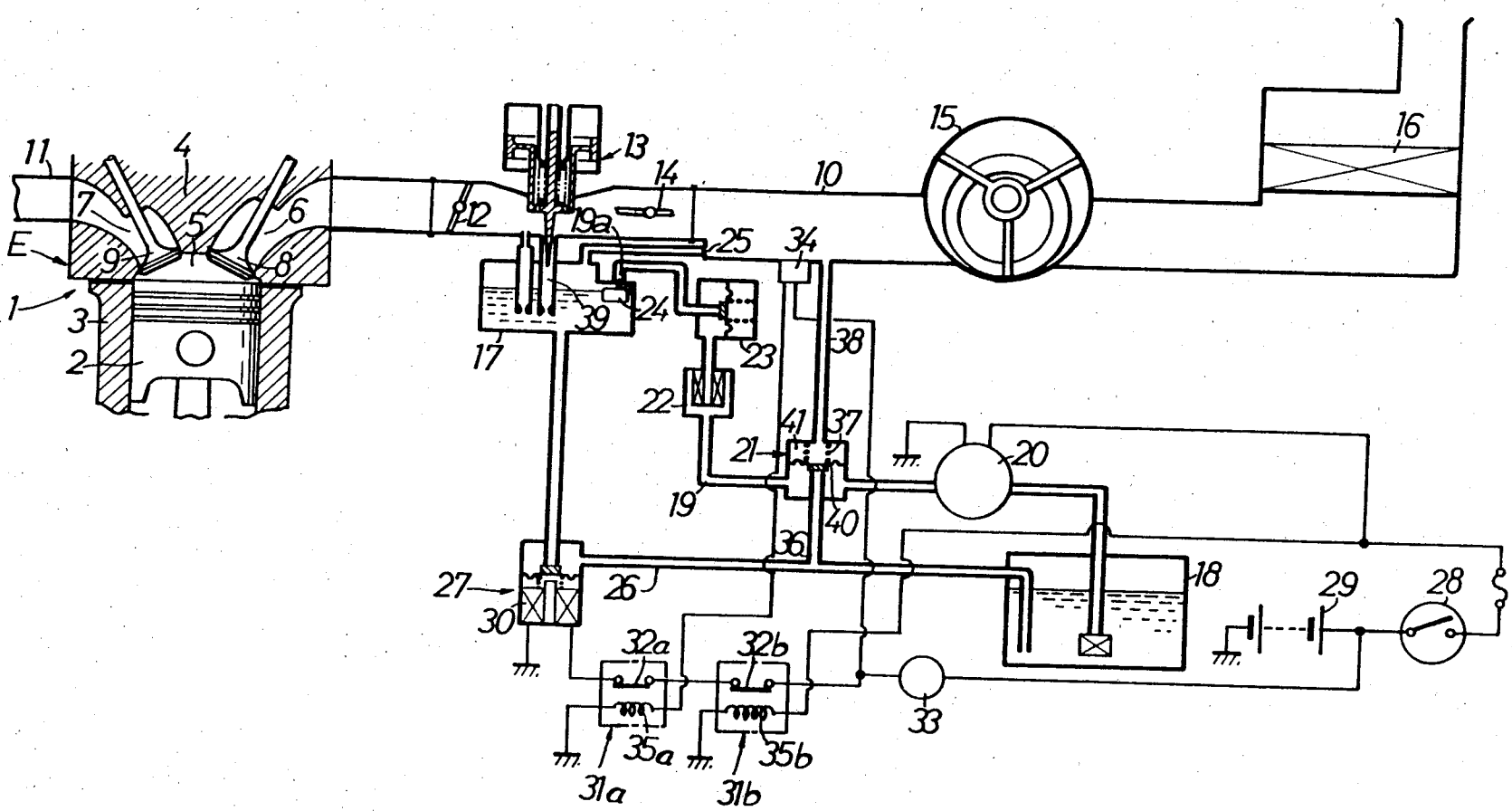

The present invention relates to a carburetor percolation prevention system for an internal combustion engine.

As an internal combustion engine runs, it generates heat. Stopping the engine will simultaneously stop the operation of the cooling system. As a result, the temperature around the area of the engine is raised due to the emission of heat from the engine. A phenomenon known as carburetor percolation is caused due to the high temperature surrounding the carburetor. Carburetor percolation gassifies the liquid fuel used in the engine, thereby making it very difficult to restart the engine.

The invention set forth herein is a carburetor percolation prevention system wherein the fuel is drained from the carburetor float chamber through an electrically controlled drain valve. The drain valve will open only when it receives a signal from an engine stop sensor, indicating that the engine is not running, and a signal from a temperature sensor, indicating that the carburetor temperature is above a predeterined value. The system uses a timer between the electric drain valve and the power source to disconnect the fuel drain valve after a set period of time. This prevents the power source from being run down.

The object of the invention is to provide a system to prevent carburetor percolation wherein the fuel in the float chamber is drained to the fuel tank. An additional object of the invention is to provide a percolation prevention system which will not drain the fuel from the float chamber if the engine is running or if the temperature is below a specified level. A further object of the invention is to provide a carburetor percolation prevention system which will conserve the power source.

Other more detailed objects of the invention will become apparent upon examination of the drawing and description contained herein, wherein;

FIG. 1 is a flow chart showing one embodiment of the present invention.

Turning in detail to the drawing, FIG. 1 illustrates an internal combustion engine E whose body 1 is constructed of a cylinder block 3 having a piston 2 slideably fitted therein. A cylinder head 4 is connected to the cylinder block 3 in an overlying fashion. A combustion chamber 5 is defined by the cylinder head 4 and the piston 2. Above the combustion chamber 5 there is an intake port 6 and an exhaust port 7 which are alternatively opened and closed by the action of the intake valve 8 and the exhaust valve 9, respectively. An intake passage 10 and an exhaust passage 11 are connected to the respective ends of the intake port 6 and the exhaust port 7.

In the intake passage 10 there is consecutively arranged from the downstream thereof, a venturi-type carburetor 13 with a downstream throttle valve 12 for opening and closing the intake passage 10 and an upstream choke valve 14, a vane pump type supercharger 15 and an air cleaner 16. The supercharger 15 is adapted to be mechanically driven by the output unit of the engine E. A float chamber 17 is located beneath the intake passage 10 and has a fuel injection nozzle 39 mounted therein.

A fuel supply passage 19 provides communication between the float chamber 17 of the carburetor 13 and the fuel tank 18. A fuel pump 20, a pressure regulator valve 21, a fuel filter 22 and a check valve 23 are consecutively disposed in the fuel supply passage 19 between the fuel tank 18 and the float chamber 17. Communication between the fuel supply passage 19 and the float chamber 17 is controlled by a float valve 24 for opening and closing the exit **19*a* of the fuel supply passage 19 into the float chamber 17. An air vent pipe 25 provides communication from the upper part of the float chamber 17 to an area of the intake passage 10 between the choke valve 14 and the supercharger 15. This allows fuel to be injected through the fuel nozzle 39 in accordance with the vacuum in the intake passage 10. An electromagnetic drain valve 27 is disposed in the fuel drain passage 26 between the float chamber 17 and the fuel tank 18. A recirculation passage 36 provides communication from the pressure regulator valve 21 to the fuel drain passage 26 between the drain valve 27 and the fuel tank 18**.

The pressure regulator valve 21 has a diaphragm device 40 for opening and closing the entrance of the recirculation passage 36. A pressure regulating spring 37 located in a spring chamber 41 on one side of the diaphragm valve 40 acts to bias the pressure regulating valve to a position which closes the recirculation passage 36. A pressure conduit 38 provides communication between the side of the diaphragm 40 with the spring chamber 41 and the air inlet passage 10, near the exit of the supercharger 15. The other side of the diaphragm valve 40 is in communication with the fuel inlet passage 19 near the exit from the fuel pump 20. As a result, the pressure regulator valve 21 is open when the pressure in the fuel inlet passage 19 exceeds the pressure set by the load value of the pressure regulating spring 37 and the exit pressure of the supercharger 15.

The not-shown drive motor of the fuel pump 20 is connected to the positive terminal of the battery 29 through the ignition switch 28 so that the fuel pump 20 is kept in its operative state while the ignition switch 28 is energized.

The exciting coil 30 for the drain valve 27 has one terminal grounded. The other terminal is connected through the contacts **32*a* and 32*b* of the primary 31*a* and secondary 31*b* electromagnetic relays and then through a timer switch 33 which is connected directly to the positive terminal of the battery 29. A temperature switch 34, which acts as a temperature sensor, is positioned in the vicinity of the carburetor 13. The temperature switch 34** opens when the surrounding temperature exceeds a predetermined level at which the percolation phenomenon can be expected to occur.

One terminal of the temperature switch 34 is connected to the contact **32*b* of the second electromagnetic relay 31*b* and then to the timer switch 33. The other terminal is connected to one terminal of the exciting coil 35*a* for the first electromagnetic relay 31*a*. The other terminal of the exciting coil 35*a* of the first electromagnetic relay 31*a*** is grounded.

The second electromagnetic relay **31*b* acts as an engine stop sensor for detecting operation of the engine E. The exciting coil 35*b* of the second electromagnetic relay 31*b* has one terminal electrically connected between the ignition switch 28 and the drive motor of the fuel pump 20. The other terminal of the second electromagnetic relay 31*b* exciting coil 35*b*** is grounded.

The timer switch 28 is constructed so as to open after a predetermined time lapse after it is supplied with electrical power. Both electromagnetic relays **31*a* and 31*b*** are normally closed relays such that when power is supplied to the corresponding exciting coils 35*a* and 35*b* respectively, the relay contacts 32*a* and 32*b* are opened.

The operations of the preferred embodiment will be explained as follows. When the ignition switch 28 is energized to run the engine E, the fuel pump 20 is driven by the not-shown drive motor to pump fuel from the fuel tank 18, through the fuel supply passage 19, towards the float chamber 17. If, at this time, the fuel in the float chamber 17 is lower than a predetermined level, the float valve 24 is open so that the fuel is supplied into the float chamber 17 through the fuel supply exit 19*a*. When the fuel in the float chamber 17 reaches a predetermined level, the float valve 24 closes. If the discharge pressure of the fuel pump exceeds the pressure required for opening the pressure regulator valve 21, the pressure in the fuel supply passage is reduced by the opening of the recirculation passage 36.

When the ignition switch 28 is closed, the electrical circuit connecting the battery 29, the ignition switch 28, and the exciting coil 35*b* of the second electromagnetic relay 31*b* is completed. This opens the contact 32*b* of the second electromagnetic relay 31*b*. As a result of this open contact 32*b*, no power is supplied to the exciting coil 30 of the drain valve 27. Thus, the fuel in the float chamber 17 is not drained to the fuel tank 18 while the ignition switch is energized. When the ignition switch 28 is de-energized such that the engine E is not running, the contact 32*b* of the second electromagnetic relay 31*b* is closed and electrical power is provided through the second electromagnetic relay 31*b* to the first electromagnetic relay 31*a*.

The first electromagnetic relay 31*a* is controlled by the temperature switch 34. When the temperature switch 34 detects a temperature above a predetermined level, the temperature sensor 34 will open thus breaking the circuit between the power source 29, the timer 33, and the primary electromagnetic relay 31*a*. The breaking of this circuit allows the first electromagnetic relay 31*a* contact 32*a* to close.

As a result, only in a condition where the ignition switch 28 is open and the temperature near the carburetor float chamber 17 exceeds a predetermined limit, both the respective contacts 32*a* and 32*b* of the first and second electromagnetic relays 31*a* and 31*b* are closed, thus providing electrical power from the battery 29, through the timer switch 33 and the two contacts 32*a* and 32*b*, to the exciting coil 30 of the drain valve 27. This opens the drain valve 27 and allows the fuel in the float chamber 17 to be retured through the fuel drain passage 26 to the fuel tank 18, thereby preventing the carburetor percolation phenomenon. After a specific time lapse, the timer switch 33 will open to conserve the battery 29.

If, after the fuel has been drained from the float chamber 17 the ignition switch 28 is reenergized to start the engine E, the fuel pump is driven, as described above, so that fuel at a normal temperature is supplied from the fuel tank 18 to the float chamber 17, for injection into the inlet passage 10 through the fuel injection nozzle 38.

We claim:

1. A carburetor percolation prevention system for an internal combustion engine including an air inlet passage, a float valve, at least one fuel injection nozzle, an ignition switch, a fuel tank, a fuel pump, a supercharger, and an electrical power source, comprising a float chamber with at least one fuel injection nozzle mounted therein, said chamber having a vent communicating the float chamber to the air inlet passage and a fuel communication passage to the fuel tank, a fuel drain passage communicating said float chamber and the fuel tank, an electrically controlled fuel drain valve disposed within said fuel drain passage, a recirculation passage comunicating said fuel communication passage and the fuel tank, a pressure regulator valve disposed between said fuel communication passage and said recirculation passage, said prssure regulator valve having a spring biased diaphragm, one side of said diaphragm having communication with the air inlet passage near the supercharger exit, the unbiased side of said diaphragm having communication with the fuel pump exit, a temperature sensor located near said float chamber, electrical switching means located between the electrical power source and said fuel drain valve such that said drain valve is opened only if the ignition switch is open and said temperture sensor detects a temperature in excess of a predetermined level, and a timer means to disconnect said fuel drain valve from said power source after said drain valve has been open for a predetermined time.

* * * * *